US006030241A

United States Patent [19]

Chiba

[11] Patent Number: 6,030,241

[45] Date of Patent: Feb. 29, 2000

[54] ELECTRICAL CONNECTOR WITH CONTACTS ORIENTED EITHER PERPENDICULAR OR STRAIGHT FOR USE ON PRINTED CIRCUIT CARDS

[75] Inventor: Taneaki Chiba, Tokyo, Japan

[73] Assignee: NEC Corporation, Tokyo, Japan

[21] Appl. No.: 09/056,913

[22] Filed: Apr. 8, 1998

[30] Foreign Application Priority Data

Apr. 11, 1997 [JP] Japan ..... 9-093465

[51] Int. Cl.[7] ..... H01R 27/00

[52] U.S. Cl. ..... 439/222; 439/654

[58] Field of Search ..... 439/222, 224, 439/654, 357

[56] References Cited

U.S. PATENT DOCUMENTS

| | | | |
|---|---|---|---|
| 3,409,859 | 11/1968 | Krehbiel | 439/357 |
| 3,581,480 | 6/1971 | O'Connor et al. | 439/222 |
| 4,740,167 | 4/1988 | Millhimes et al. | 439/222 |
| 4,969,831 | 11/1990 | Kuzumo et al. | 439/654 |
| 5,046,959 | 9/1991 | Robbins et al. | 439/92 |
| 5,833,357 | 11/1998 | Ting | 439/654 |

FOREIGN PATENT DOCUMENTS

| | | |
|---|---|---|
| 2-278678 | 11/1990 | Japan . |
| 5-21099 | 1/1993 | Japan . |
| 5-15348 | 2/1993 | Japan . |
| 6-132047 | 5/1994 | Japan . |
| 7-78660 | 3/1995 | Japan . |

*Primary Examiner*—Steven L. Stephan
*Assistant Examiner*—J. F. Duverne
*Attorney, Agent, or Firm*—Laff, Whitesel & Saret, Ltd.; J. Warren Whitesel

[57] ABSTRACT

A printed circuit board connector is formed by a fixed base portion (4) that is provided in a fixed manner onto a printed circuit board (1) and a movable base portion (5) that can be mated as one with the fixed base portion (4) in either of two (or three) different directions with respect to the fixed base portion, these directions differing from each other by 90 degrees. A cable-side connector (3) can be connected to the movable fixed base portion 5. By changing the direction of mating of the movable base portion with respect to the fixed base portion, it is possible to change the direction (compare FIGS. 3 and 4) of connection of the cable-side connector with respect to the fixed base portion. This enables the change of the connection direction of the cable with respect to the printed circuit board. This also enables the direction of connection of a cable-side connector with respect to the printed circuit board to be changed while using one and the same board-side connector, thereby enabling a reduction in the number of components required for printed circuit hardware, while achieving universality and sharing of connectors.

5 Claims, 8 Drawing Sheets

ELECTRICAL CONNECTOR WITH CONTACTS ORIENTED EITHER PERPENDICULAR OR STRAIGHT FOR USE ON PRINTED CIRCUIT CARDS

BACKGROUND OF THE INVENTION

1. Field of the Invention

The present invention relates to an electrical connector, and more specifically to an electrical connector in which the connection direction can be changed between directions that are mutually perpendicular.

2. Description of Related Art

An electrical connector has been proposed for use in making electrical connections, for example between a wiring pattern that is provided on a printed circuit board and an external electrical cable, whereby it is possible to attach and remove the connector which is mounted on the printed circuit board and the cable-side connector provided on the electrical cable, thereby enabling the electrical connection to be broken. FIG. 7 is an example of such a connector, in which a printed circuit board connector 110 has a contact pin 112 which is erected in a block 111 which has an L-shaped cross-section, this contact pin 112 being inserted into a hole which is provided in the printed circuit board 1, the outer portion thereof being connected to a wiring pattern 11 so as to mount the pin to the printed circuit board 1. A cable-side connector 120 has a rectangular block 121 that is prevented from being removed by means of a hook 113 which is provided in the above-noted board-side connector 110 which mates with a mating groove 124 of the block 121, this block having a contact 122 that is provided therein, this contact 122 mating with the above-noted contact pin 112 at the end thereof, thereby connecting the electrical cable 123 to the wiring pattern 11 on the printed circuit board 1. By mating this cable-side connector 120 to the board-side connector 110 along the above-noted connector pins 112, a connection is made between the contact pin 112 and the electrical cable 123 via the above-noted contact 122.

In the same manner, FIG. 8 shows a board-side connector 110A and a cable-side connector 120, in which case, in order to connect the electrical cable 123 in a direction that is parallel to the surface of the printed circuit board 1, the board-side connector 110 of block 111A is formed so as to have a C-shaped cross-section, and the contact pin 112A is provided so as to pass through the bottom surface of this block 111A, and also so that the middle portion thereof is bent in an approximate right angle and the end portion thereof is soldered to the printed circuit board 1.

In a connector such as described above in the prior art, to achieve a difference in the connection direction of an electrical cable with respect to a printed circuit board, it was necessary to provide a special connector for each of the connection directions. In this case, while it is possible to use a cable-side connector 120 of the same configuration regardless of the connection direction, because of the difference in the direction of the contact pin with respect to the printed circuit board, board connectors 110 and 110A, having difference configurations were required. In the reverse situation, if one and the same connector is to be used on the printed circuit board, it is necessary to have different cable-side connectors which correspond to the difference connection directions. For this reason, it is necessary to design and fabricate electrical connectors having configurations which correspond to the differing connection directions of the electrical cable with respect to the printed circuit board, this requirement running contrary to the demand in recent years for various components to be universally usable and sharable.

In view of the above-described drawbacks in the prior art, an object of the present invention is to provide an electrical connector which is capable, using one connector having an electrical cable, of making a connection to an electrical cable from mutually differing directions, thereby reducing the number of portions, while improving universality and the ability to share components.

SUMMARY OF THE INVENTION

To achieve the above-noted object, the present invention is an electrical connector comprising a pair of connectors which can be connected to each other when the respective connecting portions provided on each one of said connectors are mechanically contacted to each other, and one of said pair of connectors having a wire, wherein said one connector having the wire is provided with at least two connecting portions to which said separate connector can be connected.

And further, the present invention is an pair of electrical connector comprising a first connector and a second connector and said first connector being associated with a wire, wherein a third connector having a rectangular parallelepiped shape which can change a wire arrangement direction of said first connector, and further wherein a first connecting terminal for coupling with said first connector being provided on a first surface of said third connector and a second connecting terminal for coupling with said second connector on a second surface of said third connector being opposite to first surface thereof, and wherein a third connecting terminal for coupling said second connector being provided on a third surface of said third connector which being arranged between said first and second surface of said third connector, so that said wire arrangement direction of said wire associated with said first connector by selectively connecting said second connecting terminal or said third connecting terminal to said second connector.

DETAILED DESCRIPTION OF THE PREFERRED EMBODIMENTS

Figure 1:
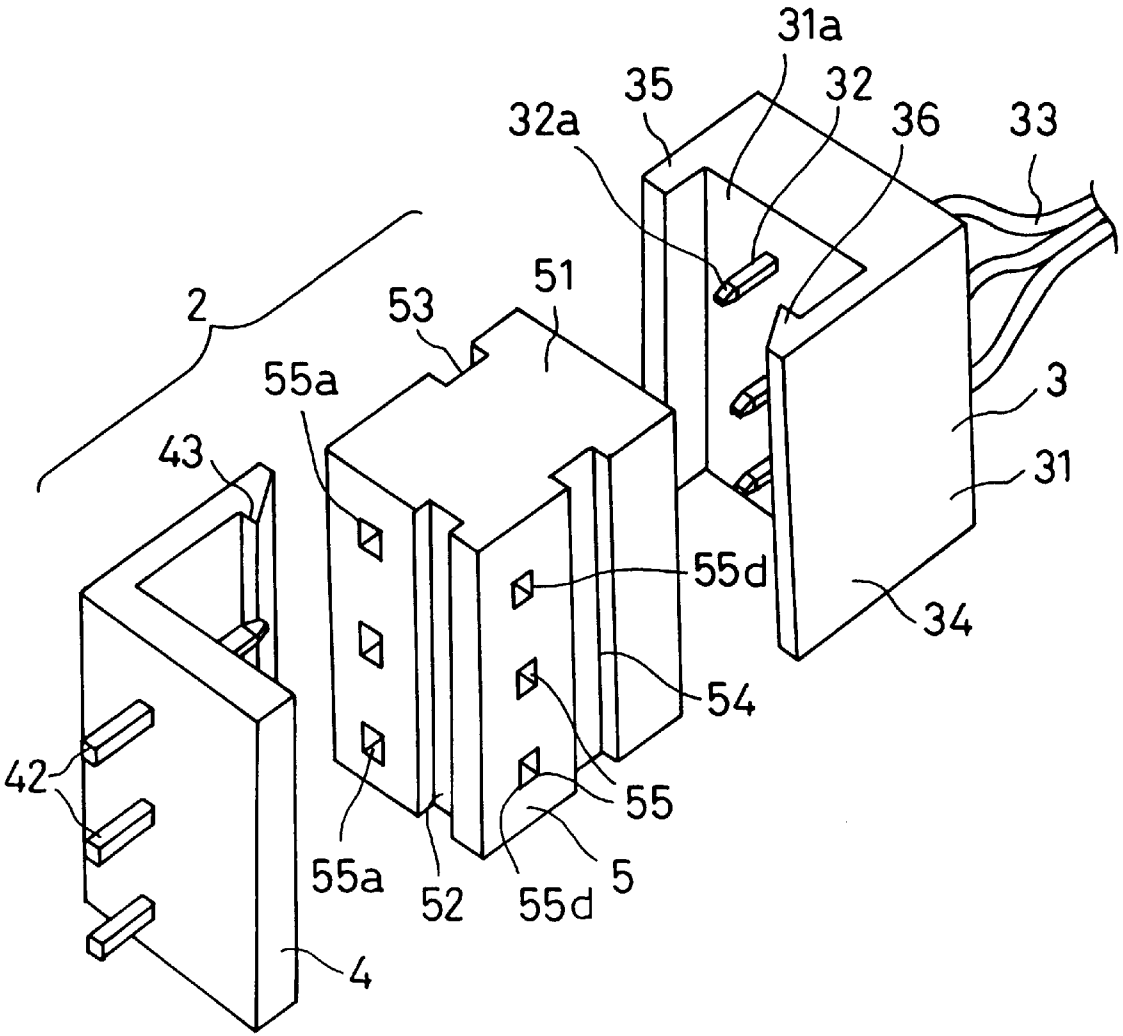
FIG. 1 is a partial expanded perspective view of an embodiment of the present invention.
Figure 3:
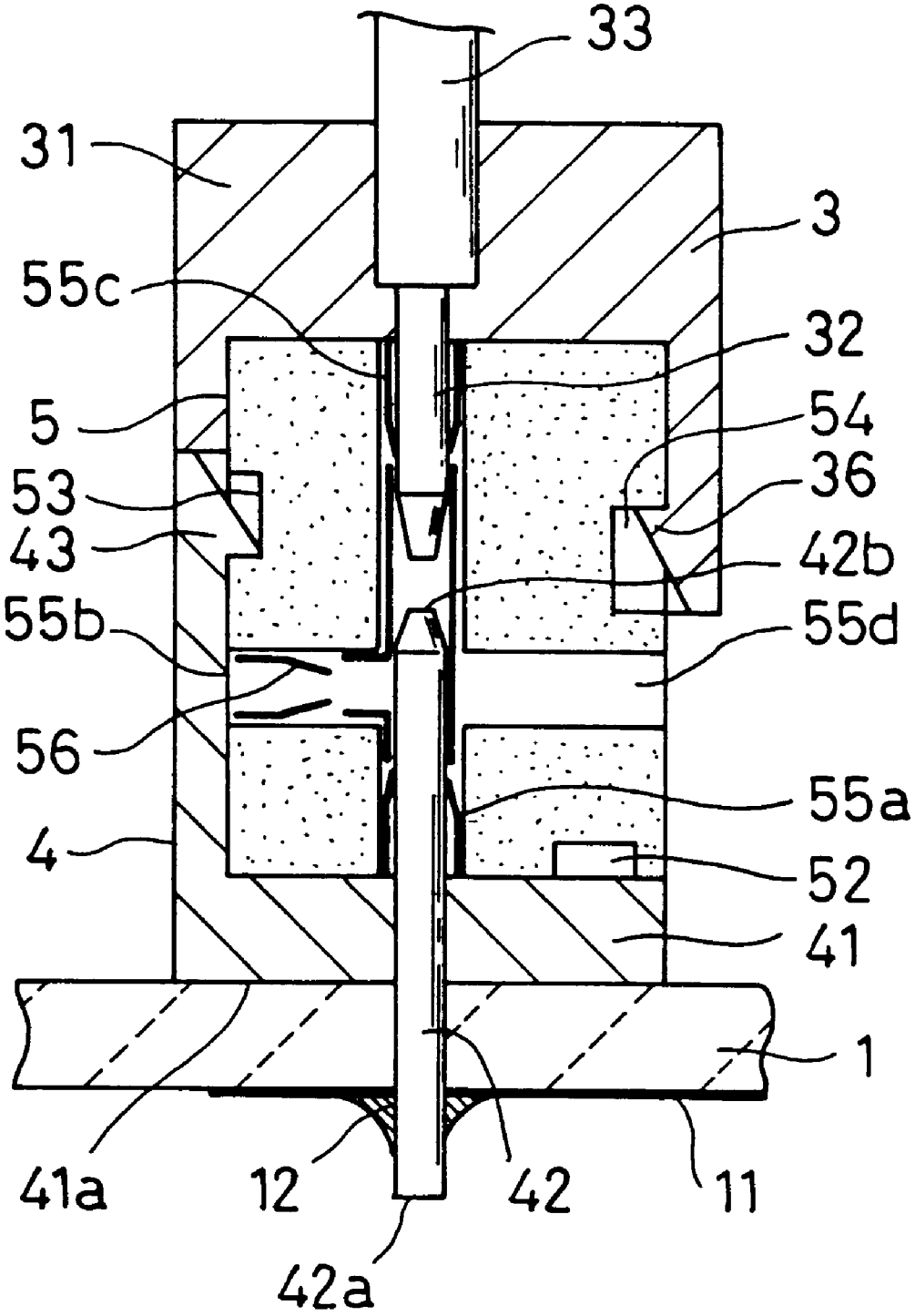
FIG. 3 is a cross-sectional view of the condition of connection of a cable in a direction that is perpendicular to the surface of a printed circuit board.

Embodiments of present invention are described below, with reference being made to the relevant accompanying drawings. FIG. 1 is a partial exploded perspective view of an example of a multiple-pin electrical connector which connects to a printed circuit board, this electrical connector being formed by a board-side connector 2 which is mounted onto a printed circuit board 1, which is shown in FIG. 3, and a cable-side connector 3 which can be attached to and removed from the board-side connector 2. The above-noted board-side connector 2 is formed by a fixed base portion 4, which is fixed to the printed circuit board 1, and a movable base portion 5, which can be attached in different directions with respect to this fixed base portion 4, and the above-noted cable-side connector 3 being configured so as to be attachable to and removable from this movable base portion 5.

The fixed base portion 4 of the above-noted board-side connector 2 is configured so that its major portion is a laterally long block 41, the cross-section of which is approximately L-shaped, a plurality of contact pins 42 (in this example, 3) being arranged in a line so as to pass through one of the sides of the L-shaped block 41. The other side of the L shape has on its inside surface a linear protrusion in along the long direction thereof, this linear protrusion serving as a mating hook 43. This fixed base portion 4, as shown in FIG. 3, in the condition in which the outer surface 41*a* of the above-noted one side is caused to come into intimate contact with the surface of the printed circuit board 1, with the above-noted contact pins 42 being provided so that the outside ends 42*a* thereof are caused to pass through contact holes that are provided in the printed circuit board 1, and so that the inside ends 42*b* thereof are perpendicular with respect to the surface of the printed circuit board 1, the outside ends 42*a* of the contact pins 42 being connected to the conductive pattern 11 of the printed circuit board 1 by solder 12.

The movable base portion 5 is formed so that its major portion is a block 51 that is a rectangular solid shape that is capable of being fitted into a space within the L-shape of the above-noted fixed base portion 4. This block 51 has grooves 52, which extends in the length direction on one side thereof, and grooves 53, 54 on the two sides which surround this one side, these grooves 52, 53, and 54 being formed so that they can mate with the mating hook 43 that is provided in the above-noted fixed base portion 4. Within the above-noted block 51 there are formed a plurality of contact holes 55 which correspond to the contact pins 42 of the fixed base portion 4 in the length direction, the internal cross-sections of which form the shape of crosses and which communicate with one another internally, these contact holes being formed in each of the three surfaces of the above-noted block in which a mating depression is formed. Inside each of the contact holes 55 are provided T-shaped contact pieces 56, as shown in FIG. 2.

Figure 2:
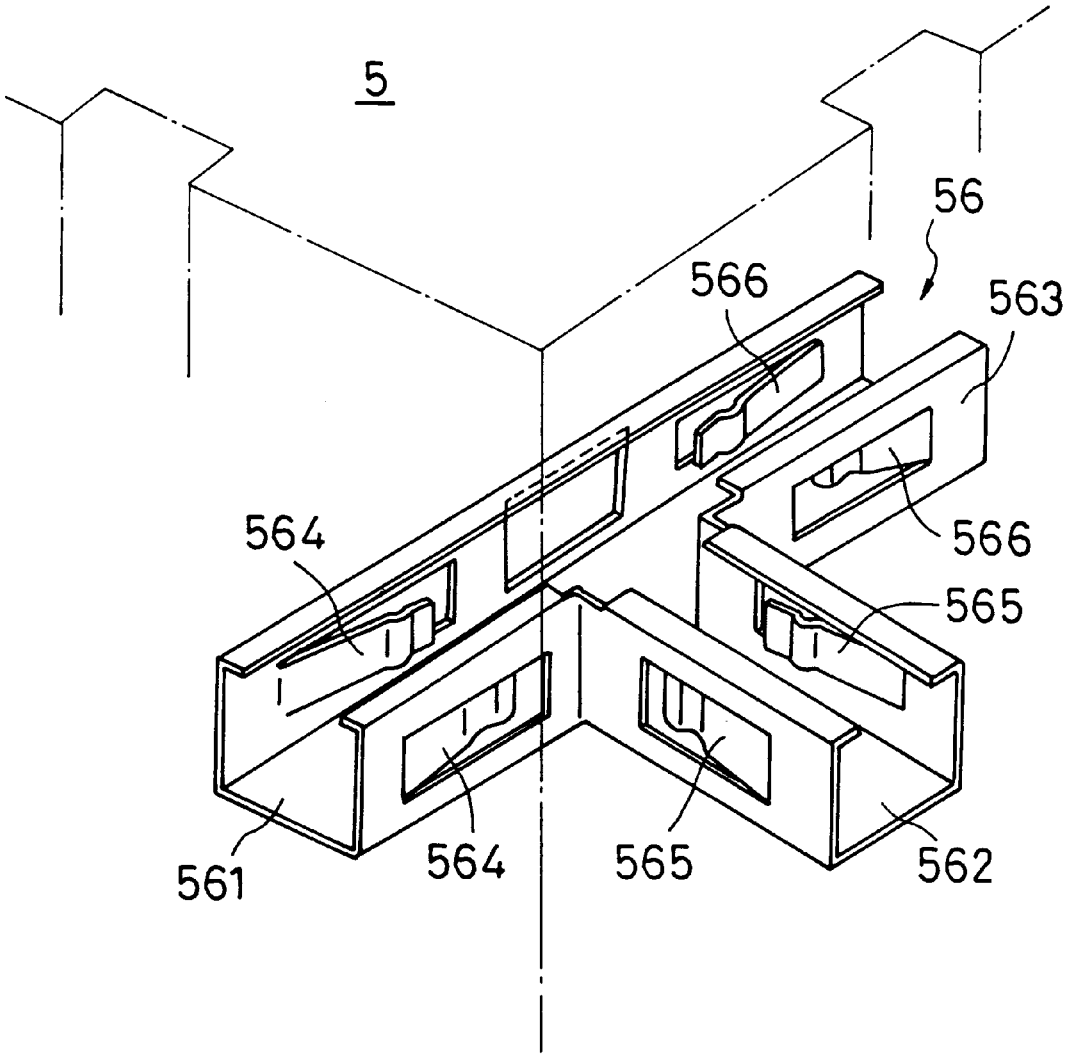
FIG. 2 is a perspective view of a contact piece provided within a movable base portion.

The above-noted contact pieces, as shown in FIG. 2, are formed by bending a conductive metal sheet, the three end portions 561, 562, and 563, which are oriented so as to be mutually perpendicular, each are formed as a hollow square tube that has one side of it cut away. At each of the end portions, into two sides which oppose each other, the resilient tongue-shaped contact pieces 564, 565, and 566, are formed by bending. when the contact piece 56 is inserted into a contact hole 55 that is provided in the above-noted movable base portion 5, each of the three end portions 561, 562, and 563 is disposed in the holes 55*a*, 55*b*, 55*c* (refer to FIG. 3), so that an electrical connection is made when a contact pin 42 is inserted into this holes. To mount the above-noted contact piece 56 inside the movable base portion 5, the movable base portion 5 is usually formed from two portions which are joined to form the whole thereof.

Additionally, the above-noted cable-side connector 3 is formed so that its major portion is a rectangular block 31, within which a plurality of contact pins 32, which correspond to the plurality of contact pins 42 of the board-side connector 2 are supported so as to pass completely therethrough, and the one ends 32*a* of these pins 32 protruding from the front surface 31*a* of the rectangular block 31 and the other ends being connected to the electrical cable 33 for the purpose of making electrical connection. On both sides of the front surface 31*a* of the rectangular block 31, a pair of holding walls 34 and 35 are provided so as to hold between them the movable base portion 5, and on the end portion of the wall 34, there is formed a mating hook 36 in the form of a wedge which is capable of mating with the mating grooves 52 through 54 of the movable base portion 5.

According to the above-described configuration, in the case of making a connector connection perpendicular with respect to the surface of the printed circuit board 1, as shown in FIG. 3, the movable base portion 5 is attached with respect to the fixed base portion 4 so that the two end portions 561 and 563, which are positioned in a straight line in the T-shaped contact piece 56, are oriented perpendicularly with respect to the printed circuit board 1. In this condition, the mating hook 43 that is provided on the fixed base portion 4 mates with the mating groove 53 of the movable base portion 5. Thereby the movable base portion 5 is hold securely on the fixed base portion 4. In this condition, the contact pins 42 of the fixed base portion 4 are inserted into and mate with the holes 55*a* of the contact holes 55 of the movable base portion 5, these being inserted into the contact pieces 56, so as to be held by and in contact with the resilient contact piece 564, thereby establishing an electrical connection between the contact pins 42 and the contact pieces 56. The cable-side connector 3 is then fitted over the top of the movable base portion 5, so that the movable base portion 5 is held between the holding walls 34 and 35 thereof, and the mating hook 36 mates with the mating groove 54 of the movable base portion 5, thereby holding the two together as one. In this condition, because the contact pins 32 of the cable-side connector 3 are inserted into the holes 55*c* of the contact holes 55 in a direction that is opposed from that of the contact pins 42 of the movable base portion 4, with an electrical connection made to the contact pieces 56 by means of the resilient contact pieces 566, the contact pins 42 and 32 are mutually electrically connected via the contact pieces 56. Therefore, it is possible to connect the cable-side connector 3 to the printed circuit board 1 so that it is perpendicular with respect to the surface thereof.

Figure 4:
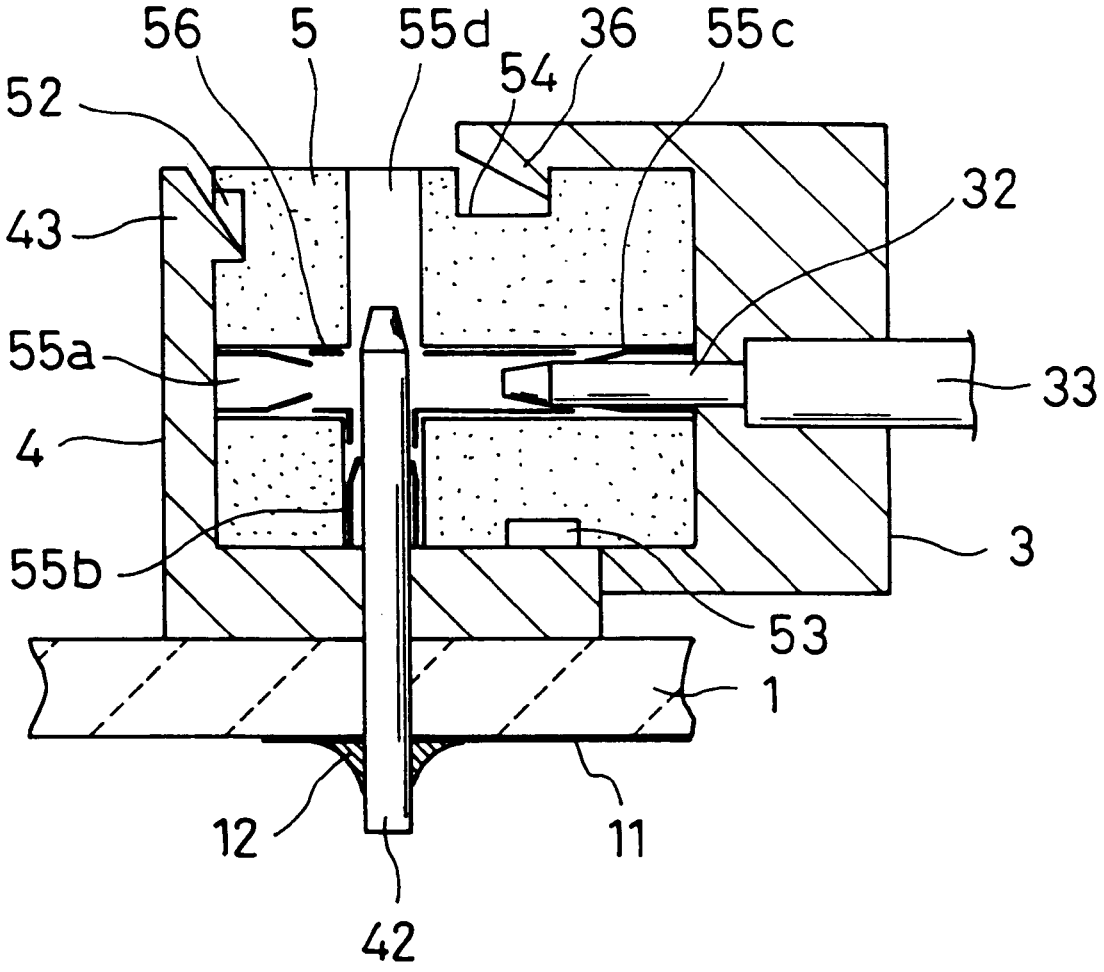
FIG. 4 is a cross-sectional view of the condition of connection of a cable in a direction that is parallel to the surface of a printed circuit board.

In the case of making a connector connection parallel with respect to the surface of the printed circuit board 1, as shown in FIG. 4, the movable base portion 5 is attached with respect to the fixed base portion 4 so that the two end portions 561 and 563, which are positioned in a straight line in the T-shaped contact piece 56, are oriented so as to be parallel with respect to the printed circuit board 1. In this condition, the mating hook 43 that is provided on the fixed base portion 4 mates with the mating groove 52 of the movable base portion 5. In this condition, the contact pins 42 of the fixed base portion 4 are inserted into and mate with the holes 55*b* of the contact holes 55 of the movable base portion 5, these being inserted into the contact pieces 56, so as to be held by and in contact with the resilient contact piece 565, thereby establishing an electrical connection between the contact pins 42 and the contact pieces 56. The cable-side connector 3 is then fitted over the movable base portion 5 from one side thereof, so that the movable base portion 5 is held between the holding walls 34 and 35 thereof, and the mating hook 36 mates with the mating groove 54, thereby holding the two together as one. In this condition, because the contact pins 32 of the cable-side connector 3 are inserted into the holes 55*c* of the contact holes 55 in a direction that perpendicular with respect to the contact pins 42 of the movable base portion 4, with an electrical connection made to the contact pieces 56 by means of the resilient contact pieces 566, the contact pins 42 and 32 are mutually electrically connected via the contact pieces 56. Therefore, it is possible to connect the cable-side connector 3 to the printed circuit board 1 so that it is parallel with respect to the surface thereof.

Thus, using this connector by providing a fixed base portion 4 on the printed circuit board 1 in a fixed manner, and by causing the movable base portion to mate with this fixed base portion 4 in directions that are 90 degrees different from one another, it is possible to achieve a board-side connector configuration in which the direction of the contact pieces 56, which are in electrical connection with the contact pins 32 of the cable-side connector 3 can differ by 90 degrees. For this reason, without the need to have either, of course, cable-side connectors 3 or even a board-side connectors having different configurations, it is possible to use one and the same type of board-side connector to make connection to a cable-side connector 3 which is mated to it from different directions with respect to the printed circuit board, thereby enabling a reduction in the number of portions and achieving universality and sharing of connectors.

Figure 5:
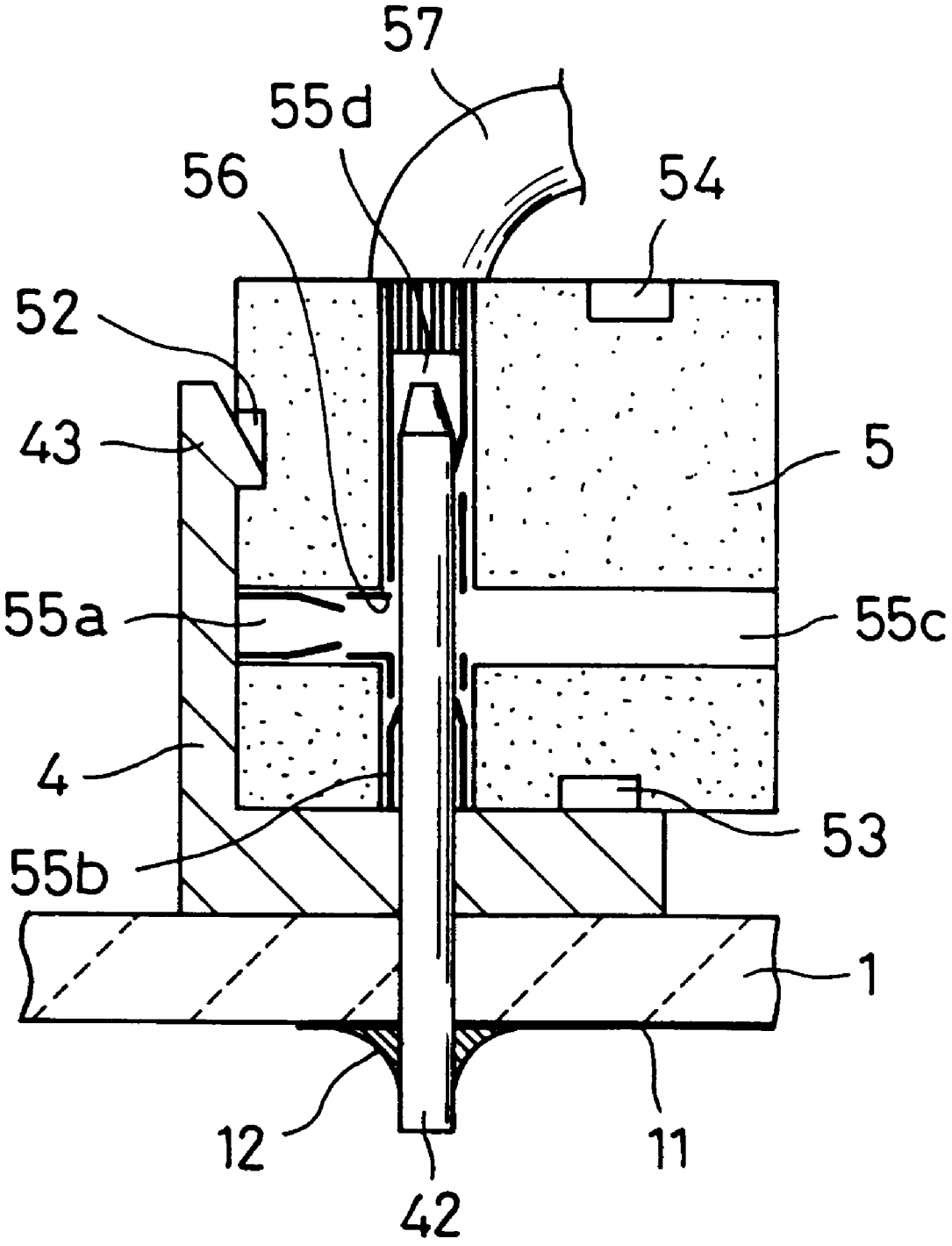
FIG. 5 is a cross-sectional view of the second embodiment of a movable base portion as a cable-side connector.

In the above-noted embodiment, as shown in FIG. 5, it is also possible to configure the movable base portion 5 as the cable-side connector, with an electrical cable 57 connected directly to one of the end portions of the contact pieces 56 provided on the movable base portion 5, which in this case is the end portion 563. By mating the movable base portion 5 to the fixed base portion 4 in a direction that is 90 degrees with respect thereto, so that the contact pins 42 provided in the fixed base portion 4 are inserted from a different direction into the contact holes 55, it is possible to make a cable connection from a direction that is perpendicular with respect to the printed circuit board 1, and also it is possible to make a cable connection from a direction that is parallel with respect to the printed circuit board 1. In this case, the cable-side connector 3 that is shown in FIG. 1 is unnecessary, thereby enabling a further reduction in the number of portions.

Figure 6:
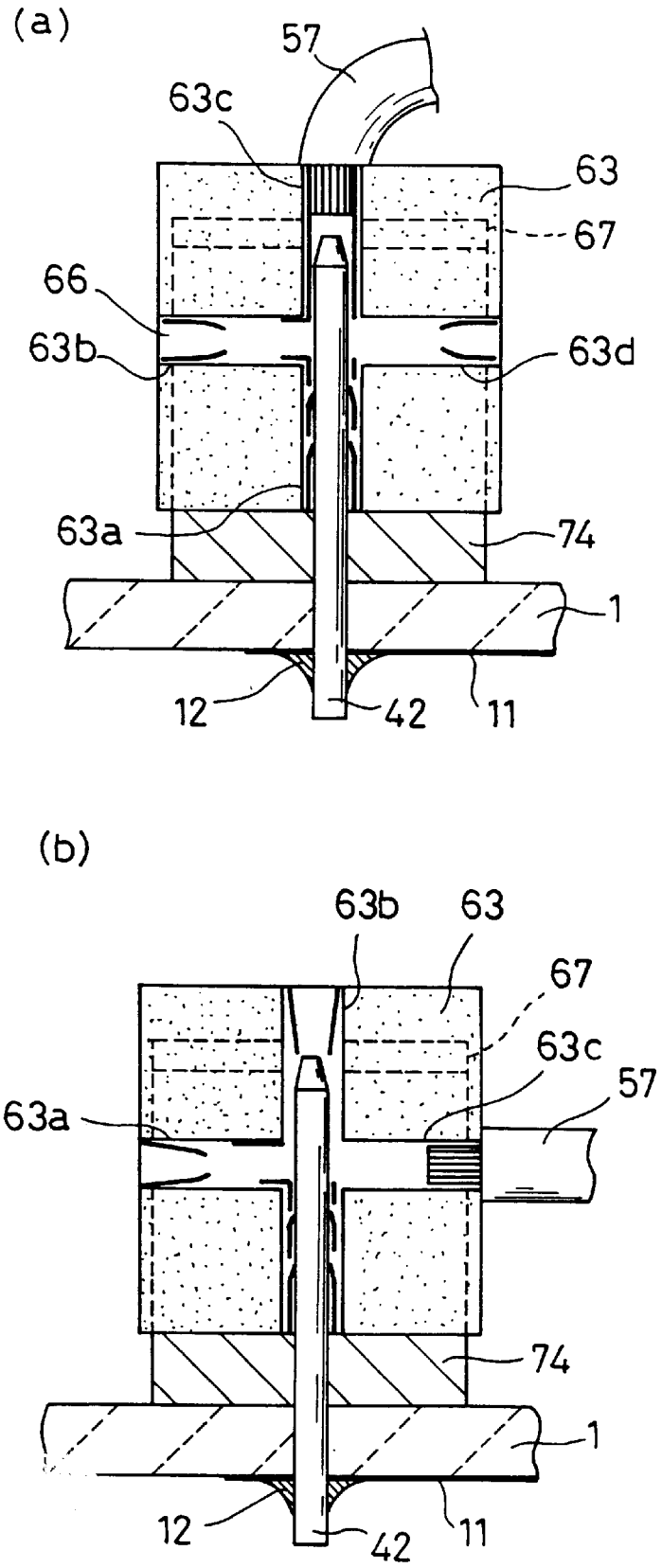
FIG. 6 is a cross-sectional view of the third embodiment of the present invention.
Figure 7:
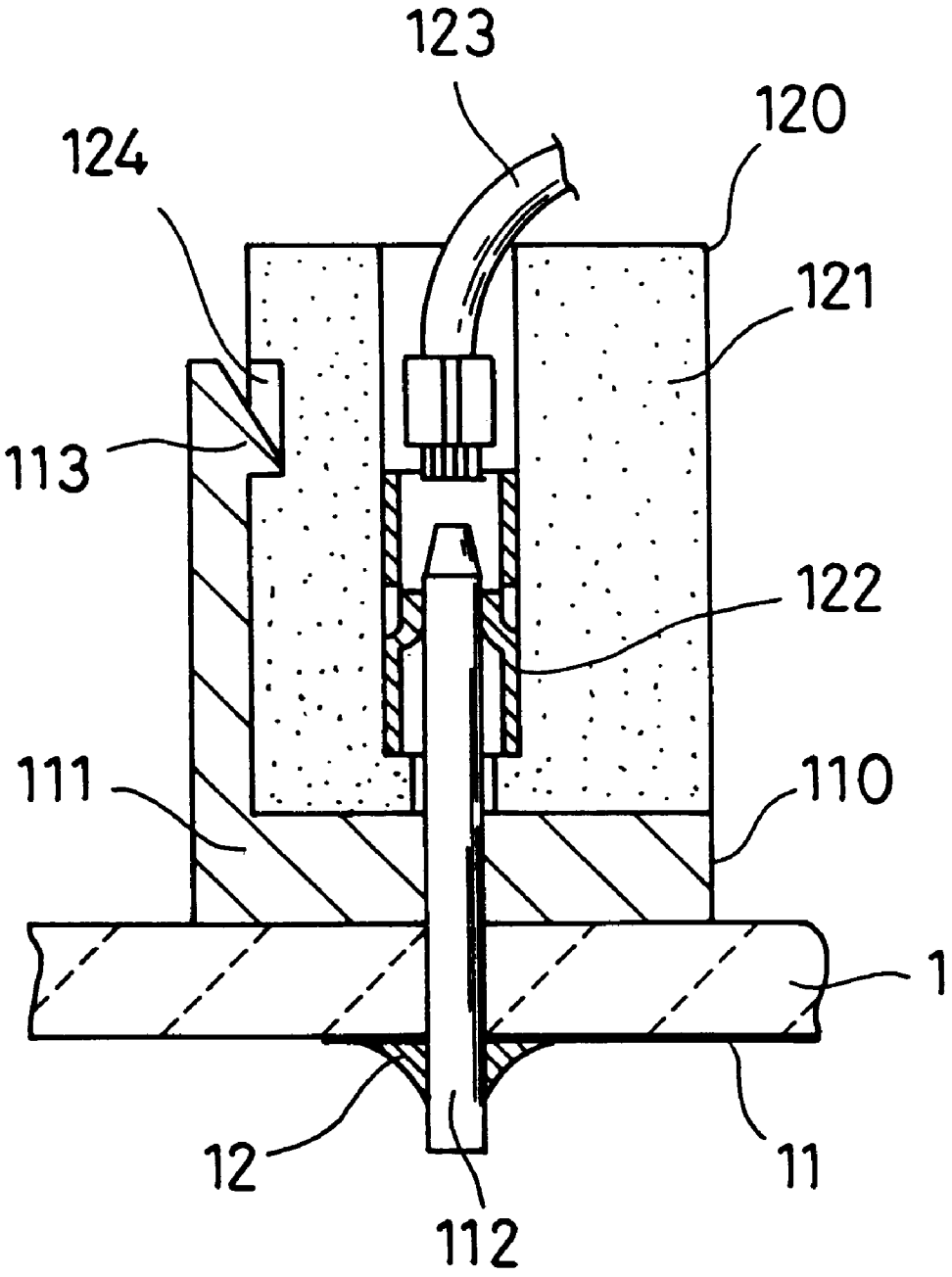
Fig. 7 PRIOR ART
FIG. 7 is a cross-sectional view of an electrical connector which connects a cable perpendicularly with respect to a printed circuit board in the past.
Figure 8:
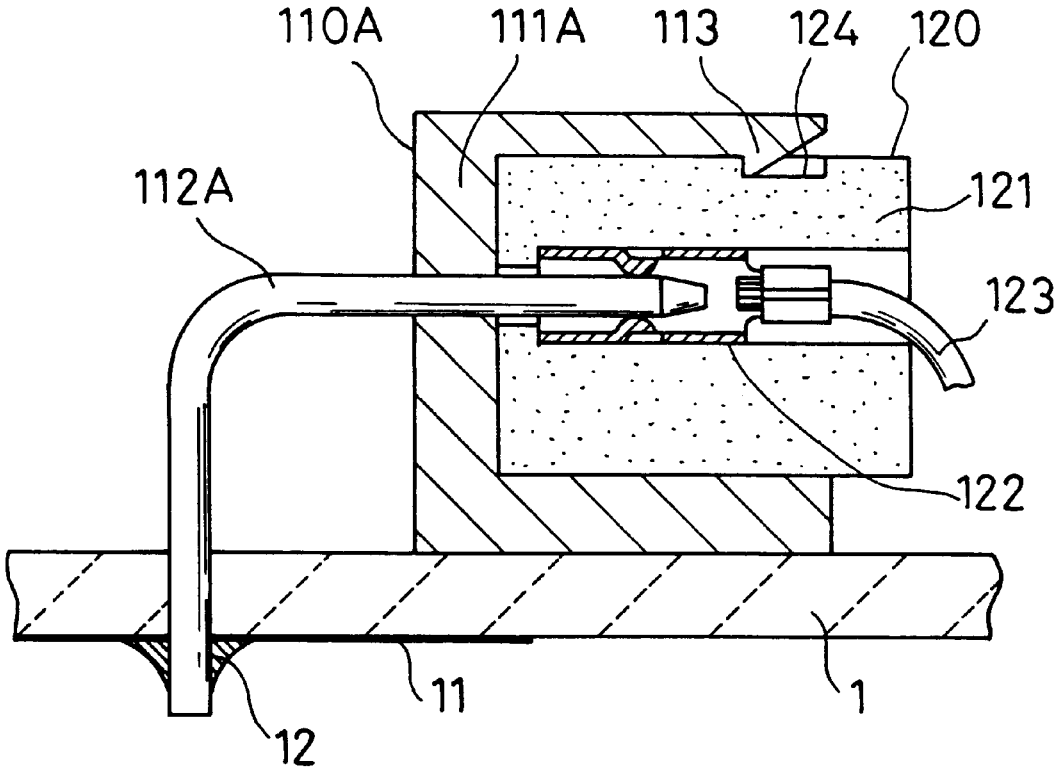
Fig. 8 PRIOR ART
FIG. 8 is a cross-sectional view of an electrical connector which connects a cable in parallel with respect to a printed circuit board in the past.

FIG. 6 shows a separate embodiment from that as shown in FIG. 5, and in this embodiment tour openings 63*a*,63*b*, 63*c* and 63*d* are provided on the cable-side connector 63 having a cable with interposing an angle of 90 degrees therebetween, respectively.

And a connecting terminals 66 which can be connected to the contacting pin 42 are provided inside each one of openings 63*a*,63*b* and 63*c*, respectively and the connecting terminal 66 which is provided inside the opening 63*d*, is connected to an electric cable 57.

Of course, the connecting terminals 66 provided inside of each one of openings 63*a*,63*b*,63*c* and 63*d* are integrally made of metal and thus it may be formed with a crossed configuration.

Accordingly, the electrical connector as shown in FIG. 6 since the connecting portions are arranged with interposing an angle of 90 degrees therebetween, the electric cable can be arranged in a direction perpendicular to the printed circuit board 1 as shown in FIG. 6(*a*) as well as being arranged in a right hand direction with respect to the connecting pin 42 in parallel with the printed circuit board 1 as shown in FIG. 6(*b*).

Further, in the present invention, although no drawing is available, the electric cable 57 can also be arranged in a left hand direction with respect to the connecting pin 42 in parallel with the printed circuit board 1.

Note that the numerical symbol 67 denotes a groove which is provided on the cable-side connector 63 to which a hook provided on the board-side connector 74, is coupled so as to fix the cable-side connector 63 to the board-side connector 74.

As explained above, in this embodiment, the direction for the wire arrangement of the electric cable 57 can be selectively set with respect to the board-side connector 74 by changing the coupling direction of the cable-side connector 63 to the board-side connector 74.

Especially, in this embodiment, since the direction of the electric cable arrangement can be selected from among three directions, the handling of the electric cable and connectors can be remarkably improved.

Further, although in the above mentioned explanation, the connecting portion of the board-side connector 4 is formed by the pin 42 and the movable base portion S and the connecting portion of the cable side connector 3,63 are formed by the connectors 56 and 66, they can be used any of the connector means which can connect separate connector each other.

While the above-noted embodiment was configured as an electrical connector for the purpose of connecting an electrical cable to a printed circuit board, it is possible to apply the present invention in the same manner to other connectors for the purpose of connecting an electrical cable to other electrical components. It will also be apparent that the number of contact pins and the number of contact pieces can be one or any arbitrary number.

According to the present invention as described in detail above, by virtue of a configuration that enables the mating of a pair of connectors in at least two directions that are mutually perpendicular, it is possible to make an electrical cable connection from different directions with respect to an electrical devices thereby enabling a reduction in the number of portions and simplifying the configuration, while enabling the achievement of universality and sharing of the connector.

What is claimed is:

1. An electrical connector for a printed circuit board comprising three connector portions for interconnecting a printed circuit board and an arrangement of wires, a first of said portions being adapted to be mounted on a printed circuit board, a second of said portions being adapted to be connected to a wiring arrangement, and a third of said portions being adapted to be positioned between said first and second portions; each of said connector portions including at least one set of contact members, the contact members on each of said connector portions mating with the contact members on the other of said connector portions when said connector portions are joined for interconnecting said printed circuit board and said wiring arrangement, and the third of said portions having a plurality of said sets of contacts with each set facing in a separate direction, whereby said first and second connector portions can be connected to each other in any one of said separate directions.

2. An electrical connector according to claim 1 wherein there are at least two of said sets of contacts in said third portion, said at least two sets of contacts being arranged to face outwardly in said separate directions which are separated from each other by 90°, the wire of said second portion extending in either of two directions separated by 90° depending upon which one of said two sets of said contact member of said third portion is connected to the sets of contact members in said portions.

3. An electrical connector according to claim 1 wherein there are three of said sets of contacts in said third portion, said three sets of contacts being arranged to face outwardly in three separate directions which are separated from each other by 90°, whereby said three sets are mutually facing 0°, 90°, and 180° respectively, the wire of said second portion extending in one of said three directions depending upon which one of said three sets of contact members of said third portion is connected to the set of contacts in one of said other portions.

4. An electrical connector according to claim 1, wherein at least one of said portions said connector portions are connected to each other by said hooked portion.

5. An electrical connector according to claim 3, wherein said three sets of contacts in said third portions are electrically connected to each other.

* * * * *